US006270895B1

(12) United States Patent
Needham et al.

(10) Patent No.: US 6,270,895 B1
(45) Date of Patent: Aug. 7, 2001

(54) GLITTER CONTAINING FILAMENTS FOR USE IN BRUSHES

(75) Inventors: Michael Christopher Needham; Charles Fletcher Nelson; David James Ruffin, all of Parkersburg, WV (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/631,393

(22) Filed: Aug. 3, 2000

Related U.S. Application Data

(62) Division of application No. 09/267,578, filed on Mar. 12, 1999.

(51) Int. Cl.[7] ..... D01F 2/00; D01F 6/00
(52) U.S. Cl. ..... 428/372; 428/393
(58) Field of Search ..... 428/323, 372, 428/506, 393; 536/56, 57

(56) References Cited

U.S. PATENT DOCUMENTS

| | | | | |
|---|---|---|---|---|
| 4,045,595 | * | 8/1977 | Chiu et al. | 428/506 |
| 4,370,375 | | 1/1983 | Bond | 428/229 |
| 5,722,106 | | 3/1998 | Masterman et al. | 15/167.1 |
| 6,225,461 | * | 5/2001 | Akimoto | 536/56 |

FOREIGN PATENT DOCUMENTS

| | | |
|---|---|---|
| 2243288 | 4/1999 | (CA) . |
| 06158428 | 6/1994 | (JP) . |
| WO 94/10539 | 5/1994 | (WO) . |
| WO 97/09906 | 3/1997 | (WO) . |

OTHER PUBLICATIONS

International Search Report, dated Jul. 24, 2000.

* cited by examiner

*Primary Examiner*—Newton Edwards

(57) ABSTRACT

A thermoplastic polymer monofilament oriented from 3.0–6.0 times its original length having a diameter of 125–600 microns and containing 0.2–5.0% by weight, based on the weight of the monofilament, of glitter particles or film particles having a particle size of 50–400 microns in its longest diameter, a thickness of 2–50 microns and having a diameter to thickness ratio of at least 2 to 1 and wherein the longest diameter of the particle is not greater than 80% of the diameter of the monofilament and that provide the monofilament with an attractive appearance. A core sheath monofilament is also part of this invention wherein the core is a thermoplastic polymer monofilament having a sheath of the same or different thermoplastic polymer containing the above described particles. These monofilaments are particularly useful in toothbrushes and cosmetic brushes.

15 Claims, No Drawings

GLITTER CONTAINING FILAMENTS FOR USE IN BRUSHES

This application is a divisional of Ser. No. 09/267,578 filed Mar. 12, 1999, now allowed. (pending)

BACKGROUND OF THE INVENTION

This invention is directed to thermoplastic polymer monofilaments containing a flake additive to provide monofilaments having an attractive glitter that are useful in brushes such as tooth brushes and cosmetic brushes.

Polyamide monofilaments have been used widely for bristles in brushes such as cosmetics brushes and tooth brushes. Abrasive materials have been incorporated into monofilaments that are used as bristles in tooth brushes as shown in U.S. Pat. No. 5,722,106 issued on Mar. 3, 1998 to Masterman et al. These abrasive materials are usually small particles (0.1–10 microns) but are not visible as distinct particles and are used in relatively high amounts such as 10–40% by weight of the monofilament. However, these particles do not provide an attractive glitter to the monofilaments and the monofilaments are often much more abrasive than needed.

Particles of plastic materials that are relatively thermally stable also have been incorporated into monofilaments that are used as bristles in tooth brushes to produce bristles with a structured surface that is mildly abrasive as shown in WO97/09906 published Mar. 20, 1997. These particles of plastic materials are usually blended at a level of 5–30% by weight of the total weight of the filament and are limited to 10–50% of the diameter of the filament. These particles often cause breakage in the filament during processing.

There is a need for monofilaments that have an attractive appearance for use in tooth brushes and other brush applications that are only mildly abrasive and contain a relatively small amount of the abrasive material and are stronger and more wear resistant than those previously made. The monofilaments of the present invention provide such advantages.

SUMMARY OF THE INVENTION

A thermoplastic polymer monofilament oriented from 3.0–6.0 times its original length having a diameter of 125–600 microns and containing 0.2–5.0% by weight, based on the weight of the monofilament, of glitter particles or film particles having a particle size of 50–400 microns in its longest diameter, a thickness of 2–50 microns and having a diameter to thickness ratio of at least 2 to 1 and wherein the longest diameter of the particle is not greater than 80% of the diameter of the monofilament and that provide the monofilament with an attractive appearance. A core sheath monofilament is also part of this invention wherein the core is a thermoplastic polymer monofilament having a sheath of the same or different thermoplastic polymer containing the above described particles. These monofilaments are particularly useful in toothbrushes and cosmetic brushes.

DETAILED DESCRIPTION OF THE INVENTION

The thermoplastic polymer monofilament is oriented in its original length from 3.0–6.0 times and has a diameter of 125–600 microns. The monofilament has uniformly dispersed through out glitter particles which are in the form of flakes that have a diameter in the longest dimension of 50–400 microns and a thickness of 2–50 microns and a diameter to thickness ratio of at least 2 to 1. To substantially reduce filament breakage during the manufacture of the filament, the largest diameter of the particles is not greater than 80% of the diameter of the filament. These particles provide the monofilament with an attractive appearance and often protrude through the surface of the monofilament or locally increase the diameter of the monofilament to provide mildly abrasive properties to the filament. Particles that are below 50 microns in the longest diameter can not be distinguished easily by the human eye as a distinct particle. Dyes or pigments that have a contrasting color to the glitter particles also can be added to the monofilament which adds to the attractive appearance of the monofilament. Aluminum flake particles are particularly visible in the filaments due to their high reflectance of light.

Another aspect of this invention is a core sheath monofilament in which the core is an oriented thermoplastic polymer and the sheath is the same or different thermoplastic polymer having the above described abrasive particles and optionally, can contain dyes to provide and attractive monofilament. This core sheath monofilament increases the visibility and abrasiveness of the flake particles by locating all of the flake particles at or near the surface in the sheath polymer and reduces the occurrences of strand breakage during the orientation step of the process for making such filaments since the core of the filament remains unaffected.

The monofilaments of this invention are particularly useful for the bristles of brushes, in particular tooth brushes and cosmetic brushes. Other uses of these monofilaments are as follows: paint brushes, abrasive brushes, synthetic hair for wigs, doll hair and the like.

A wide variety of thermoplastic polymers can be used to form the monofilament such as polyamides, polyesters, polyolefins, polystyrenes, styrene copolymers, fluoropolymers, polyvinylchloride, polyurethane, polyvinylidene chloride, and any compatible combination thereof.

Polyamides preferred in brush manufacturing include nylon 6, nylon 11, nylon 6,6, nylon 6,10 nylon 10,10, and nylon 6,12. Particularly preferred is nylon 6,12 (polyhexamethylene dodecanoamide) having an inherent viscosity of 1.15–1.25 measured in m-cresol according to ASTM D-2857.

Polyesters which have been found particularly well suited for bristle include polybutylene terephthalate and polyethylene terephthalate, of which the first is particularly preferred. Of the many polyolefins which can be used for bristle manufacture, polypropylene is preferred.

The glitter particles used in the monofilament are flakes that have a particle size of 50–400 microns in the longest diameter, preferably 50–150 microns, a thickness of 2–50 microns, preferably 8–20 microns and a diameter to thickness ratio of at least 2/1, preferably 5/1–10/1. The diameter to thickness ratio of the particles is important and if outside of the above range or if the diameter of the particle is greater than 80% of the diameter of the monofilament, there is a substantial increase of the occurrence of breaks in the filament as it is being oriented in the manufacturing process. The particles are present in an amount of 0.2–5.0% by weight, based on the weight of the monofilament and preferably in an amount of 0.5–2.0%. If the particles are below the size range and amount range set forth above, the glitter effects will not be noticeable to any appreciable extent. The particles are of such a material that provides a sparkle or glitter to the monofilament that improves its aesthetics for use in tooth brushes and cosmetic brushes and also provides mild abrasive properties to the monofilament which aids in the polishing action of a brush such as a tooth brush.

Preferred flake particles are flakes of aluminum and cellophane. Aluminum has excellent light reflecting properties which improves its visibility in the filaments. It is inexpensive, widely available in film and flake form and is safe to use. Aluminum flake that is approved for food contact is preferred for use in tooth brushes. Aluminum and cellophane are not melted or destroyed in the processing steps used to form the filaments. Preferably, these flakes are formed by die cutting aluminum foil or cellophane sheets. Die cutting the sheet or foil is preferred to grinding (either with or without subsequent screening ) of the foil or sheet since cutting produces substantially more regularly sized flakes than does grinding. A narrow particle size of aluminum flake or cellophane flake is much preferred since fines or large particles are detrimental to the filament. Grinding foils or sheets creates a lot of size variation.

Small flakes (below 50 microns) are not readily visible to the human eye as distinct particles and alter or dilute the color of the filament. Flakes larger than the optimum size create additional failures of the filament strands during the orientation step. Preferably, the longest flake diameter should be 40–75% of the filament diameter.

Aluminum flakes produced from a film of 12.7 microns (0.5 mil) in thickness or lower are preferred. Preferably, coated aluminum is used to form the flakes, since the coating improves die-cutting accuracy and size uniformity. The coating on the aluminum also reduces oxidation of the aluminum surface. Typical coatings used on the aluminum are polyurethanes or acrylics, typically at a level of 2–10% by weight of the aluminum. The coating can be clear to provide a silver color or it can be pigmented or tinted to provide, for example, a gold coating or other color.

Cellophane also can be used as a glitter particle. Since cellophane is not a plastic, it will not melt during the spinning process used in forming the filament. Colored cellophane can be used and with the proper selection of colorants, colored cellophane can be used that has approval for food contact which is highly preferred for use in tooth brushes. The color of the cellophane can be chosen to improve attractiveness and glitter of the filament. Cellophane can be coated or uncoated with uncoated cellophane being preferred. To form glitter particles of cellophane, flakes of cellophane can be die cut which is preferred for optimum particle size and uniformity or the cellophane may be ground and classified for a specified flake size and range. It is preferred to use cellophane that is 12.7 microns (0.5 mils) thick or thinner to minimize filament strand breakage during the orientation step. Preferred longest cellophane flake diameter is 40–75% of the filament diameter for the best balance of maximum visibility, attractiveness, and abrasiveness and that provides acceptable levels of strand breaks during the orientation step of filament formation.

To improve or enhance the polishing characteristics of the filament, 0.1–10% by weight, based on the weight of the filament, of abrasive particles having a particle size of 0.5–40 microns are added. The amount of abrasive used must not detract from the glitter or attractiveness of the filament. Typically useful abrasive particles are as follows: China clay, silicon carbide, aluminum oxide, alumina zirconia, silicon dioxide, sodium aluminum silicate, cubic boron nitride, garnet, pumice, emery, mica, quartz, diamond, boron carbide, fused alumina, sintered alumina, walnut shells and any mixtures thereof.

Process for Forming the Filament

In making the filament, an extruder is used such as a W & P (Werner and Pfleiderer) extruder. The thermoplastic polymer in form of granules is fed from a feeder unit into the extruder either volumetrically or gravimetrically. The filament also can be melt spun. The glitter flake particles and the optional abrasive particles are fed from a separate feeder into the extruder as is the colorant, if used, and blended with the thermoplastic polymer in the extruder at a temperature of 150–285° C. Alternatively, the glitter flake particles and colorants, if used, can be pre-compounded with the thermoplastic polymer or can be pre blended with the thermoplastic polymer so that a separate feeder is not required. The blended mixture of polymer, glitter flake particles and optional abrasive is then metered to a spin pack having a die plate and filaments of various shapes (not limited to solid round shape) and sizes are produced. The shape of the filament cross section is determined by the shape of the holes in the die plate and may be any cross sectional shape such as round, oval, rectangular, triangular, any regular polygon or an irregular non circular shape and may be solid, hollow or contain multiple longitudinal voids in its cross sections. Each run of the extruder can produce any combination of cross-sectional shapes by using a die plate with various shaped holes. Strands of one or more diameters may be made at the same time by changing the size of the holes in the die plate.

After exiting the die plate, the bundle of filament strands is solidified in a quench water bath and then transported through a series of draw rolls for stretching of the filament strand. The filament strands are then transported through the heat set oven to heat set the filaments. The filament strands are then wound on a winder which is usually a drum or a spool. Optionally, the filaments can be surface treated to enhance or modify surface properties such as the coefficient of friction.

Another aspect of this invention is a core sheath filament in which the sheath contains the glitter particles and the core is only the thermoplastic polymer which does not contain the glitter particles. Typically, the diameter of the filament is 125–600 microns with the core having a diameter of 50–550 microns. The thermoplastic polymer used in the core and the sheath may be the same or different but must be compatible since there must be adequate adhesion between the core and the sheath. Preferred combinations include polyester cores (such as polybutylene terephthalate) with thermoplastic elastomer sheaths and polyamide cores (such as nylon 6,12) with other polyamide sheaths.

Core sheath filaments are typically produced with two extruders sharing a common spin pack. The core material is fed into the core extruder and is selected from a wide variety of thermoplastic polymers. Colorant can be added to the ore material. The core material is melted in the extruder and is channeled to the center of the spin plate holes. The sheath material containing the glitter particles is fed into the sheath extruder. The sheath material is melted and is channeled to the outside of the spin plate holes.

The advantage of core sheath filament is that there is less breakage of the filament in the orientation step of the process in comparison to the process for making a monofilament using polymer filled with glitter particles. The presence of particles in the polymer increased the breakage of the filament during orientation. If particles agglomerate in one area during mixing and extruding, the filament will be weakened at that point and has a tendency to break. With a core sheath filament, the core material provides the necessary strength during the orientation step(s) to significantly reduce filament breakage.

The filaments of this invention are used in particular to make tooth brushes and cosmetic brushes. When aluminum particles are used in the filament, the filament sparkles and glitters and makes a particularly attractive tooth brush and does provide a mild abrasive which is beneficial in tooth brushing. Also, attractive filaments are formed by using cellophane particles in the filament and the filaments are useful in tooth brushes and other brushes.

The following examples illustrate the invention. All parts and percentages are on a weight basis unless otherwise indicated.

EXAMPLE 1

Filaments 1–7 were prepared by first forming aluminum glitter particles by die-cutting 0.5 mil (12.7 micron) thick aluminum foil coated with 6% by weight, based on the weight of the aluminum foil, of an acrylic polymer coating to 4×4 mil (101.6×1.01.6 micron) sized flake particles. The polymer used is Nylon 6,12 (polyhexamethylene dodecanoamide) having an inherent viscosity of 1.15–1.25 measured in m-cresol according to ASTM D-2857. Colorants were used in the filaments as shown in Table 1. Filament 7 used 5% by weight of aluminum silicate having a particle size of 0.5–10.0 microns as an abrasive.

7 different filaments were prepared having a diameters of 6.0, 7.0, 8.0, 8.5 mils containing different colorants, percentages of aluminum flake particles. A 28 mm W&P extruder having six zones heated to about 230–250° C. was used in which the polyamide, glitter particles of aluminum flake, colorant and abrasive are separately fed into the extruder and mixed. The resulting mixture is metered into a spin pack with a die plate and filaments are extruded into a water quench bath which is at room temperature and then transported over a series of draw rolls for stretching the filaments at a draw ratio of 3.5–4. The filaments are then passed through a heat set oven to heat set the filaments and are wound onto a spool.

Each of the above Filaments 1–7 had an excellent appearance. The glitter of the filaments was attractive and when used as bristles in a tooth brush gave the tooth brush an outstanding appearance. The filaments had the following properties shown in the table and each was formed into a tooth brush and the brush tested for wear and the bristles of the brush were measured for tuft retention.

TABLE 1

| Filament | Diameter | % Glitter | % Abrasive | Colorant | Wear Test | Tuft Retention (kg) |
|---|---|---|---|---|---|---|
| Example 1 | | | | | | |
| 1. | 6 mils (152.4 microns) | 1.25 Al | 0 | Pigment Red 220 | 62% | 1.68 |
| 2. | 7 mils (177.8 microns) | 1.25 Al | 0 | Pigment Red 177 | 47% | 1.64 |
| 3. | 7.5 mils (190.5 microns) | 0.6 Al | 0 | Pigment Blue 15 | 69% | 1.77 |
| 4. | 8.5 mils (216 microns) | 0.8 Al | 0 | Pigment Red 220 | 69% | 2.09 |
| 5. | 8 mils (203.2 microns) | 1.25 Al | 0 | Pigment Blue 151 | 49% | 1.59 |
| 6. | 8 mils (203.2 microns) | 1.5 Al | 0 | Solvent Red 52/ Pigment Green 7 | 35% | 1.64 |

TABLE 1-continued

| Filament | Diameter | % Glitter | % Abrasive | Colorant | Wear Test | Tuft Retention (kg) |
|---|---|---|---|---|---|---|
| 7. | 8 mils (203.2 microns) | 2.0 Al | 5.0 | No colorant | 32% | 1.77 |

The Wear Test is a Jordan Wear Test wherein a Jordan wear tester is used having 5 brush clamps arranged side by side in which brushes are mounted with the long axis perpendicular to the contact surface. The contact surface is made up of five 1 cm diameter stainless steel rods set adjacent and parallel to each other. The motion of the brushes, from a position clear of the contact surface is to move across the 5 cm surface (across the 5 rods) and completely off the other side. The return stroke moves the brushes back across the contact surface to the starting position. The machine runs about 79 strokes (back and forth) each minute. The height of the base of the toothbrush above the contact surface is about 2 mm above the contact surface to insure the brush holder does not hit the surface.

Each brush clamp is mounted in a "floating" assembly with a holder for weights so the load on each brush can be set independently. An auxiliary water temperature control unit is used to maintain water temperature and to pump water to nozzles in the wear tester which direct streams of water to each brush position. While in operation, the contact surfaces is flooded with water.

Test conditions are as follows: 5 brushes per sample of filament are positioned in the holders to alternate with a control sample, 500 grams are applied per brush, 90 minutes scrub cycles are used with the water at 35° C. The width of the brush is measured before the scrub cycle and again after the scrub cycle after an overnight recover at 23° C. and 50% relative humidity.

% Wear is calculated as follows: final width of the brush minus initial width divided by the initial width times 100.

To be commercially acceptable, a brush can have a maximum % Wear as determined above of 80% and must have a Tuft Retention of 1.4 kg. Each of the Filaments tested above have less than 80% Wear and a Tuft Retention over 1.4 kg and were considered to be commercially acceptable brushes.

EXAMPLE 2

0.5 mil (12.7 micron) thick green and red colored uncoated cellophane sheet was ground and screened between 80–170 mesh screens (88–190 microns). The cellophane flakes were then pre-compounded with colorant (titanium dioxide pigment) and nylon 6,12 resin using an extruder and then cut into small pellets. Filaments were prepared as in Example 1 using the same procedure and tested as in Example 1 except the above pellets were used to form the filaments. The filaments had a white background which contrasted with the colored cellophane and had an excellent appearance. The larger cellophane flakes resulted in enlarged localized filament cross-sections providing a mildly abrasive filament. Tooth bushes formed from the filaments had an outstanding appearance and the brushes were tested for Wear and for Tuft Retention as in Example 1 and the results are shown in Table 2. The brushes had acceptable % Wear and Tuft Retention and were considered commercially acceptable brushes.

Filaments were made as above using a dark blue colorant with white cellophane flakes and when formed into a tooth brush gave a brush with an attractive appearance.

TABLE 2

| Filament | Diameter | % Glitter | % Abrasive | Colorant | Wear Test | Tuft Retention (kg) |
|---|---|---|---|---|---|---|
| Example 2 | | | | | | |
| 8. | 8 mils (203.2 microns) | 1.2 Cellophane | 0 | Titanium dioxide pigment | 35% | 1.91 |
| 9. | 8.5 mils (216 microns) | 0.8 Cellophane | 0 | Titanium Dioxide Pigment | 51% | 1.86 |
| 10. | 7.0 mils (177.8 microns) | 1.2 Cellophane | 0 | Titanium Dioxide Pigment | 47% | 1.41 |

EXAMPLE 3 (COMPARATIVE EXAMPLE)

Polyethylene terephthalate (PET) film 0.5 mils (12.7 microns) was die cut into flakes the same size as those in Example 1. Filaments were prepared using the same procedure as in Example 1 except the above prepared PET flake was substituted for the aluminum flake. Each of the filaments had a poor appearance since the flakes melted or were deformed in the extrusion process and there was discoloration of the filament.

EXAMPLE 4 (COMPARATIVE EXAMPLE)

A screened sample of mica flakes ("Dekorflake" Silver 125 having an average particle size of 125 microns, but the particle size range was 40–300 microns) was substituted for the aluminum glitter of Example 1 at a 1% by weight level and a 2% orange colorant was used. An 8 mil (203.2 micron) filament was extruded using the process of Example 1. Processing of the filament was not satisfactory since the large size of flakes caused excessive strand breakage in the orientation step. Certain flake particles were larger in diameter than the filament and caused breakage problems. The resulting filament that was produced did not have an attractive appearance since the mica particles gave the filament a gray appearance and did not adequately reflect light to provide a glitter appearance.

What is claimed is:

1. A thermoplastic polymer monofilament oriented from 3.0–6.0 times its original length having a diameter of 125–600 microns and containing 0.2–5.0% by weight, based on the weight of the monofilament, of film particles having a particle size of 50–400 microns in its longest diameter, a thickness of 2–50 microns and having a diameter to thickness ratio of at least 2 to 1 and wherein the longest diameter of the particle is not greater than 80% of the diameter of the monofilament.

2. The monofilament of claim 1 in which the film is cellophane.

3. The monofilament of claim 2 wherein the cellophane is colored.

4. The monofilament of claim 2 wherein the cellophane is uncoated.

5. The monofilament of claim 1 wherein the film is aluminum.

6. A thermoplastic polymer monofilament oriented from 3.0–6.0 times its original length and having a diameter of 125–600 microns; and containing 0.2–5.0% by weight, based on the weight of the monofilament, of cellophane flakes having a particle size of 50–400 microns in its longest diameter, a thickness of 2–50 microns and having a diameter to thickness ratio of at least 2 to 1, wherein the longest diameter of the particle is not greater than 80% of the diameter of the filament.

7. The monofilament of claim 1 wherein the cellophane flakes have a particle size of 50~150 microns in the longest diameter.

8. The monofilament of claim 6 wherein the cellophane flakes have a thickness of 8–20 microns.

9. The monofilament of claim 6 wherein the cellophane flakes have a diameter to thickness ratio of 5/1 to 10/1.

10. The monofilament of claim 6 wherein the longest diameter of the cellophane flakes is 40~75% of the diameter of the filament.

11. The monofilament of claim 6 wherein the cellophane is colored.

12. The monofilament of claim 6 wherein the cellophane is uncoated.

13. The monofilament of claim 6 wherein the thermoplastic polymer is a polyamide.

14. The monofilament of claim 6 wherein the composition further comprises abrasive particles having a particle size of 0.5–40 microns.

15. The monofilament of claim 6 further containing a dye or pigment that has a contrasting color to the cellophane flakes.

* * * * *